United States Patent [19]

Gaeti

[11] Patent Number: 4,922,873

[45] Date of Patent: May 8, 1990

[54] ELECTROMECHANICAL RUN/STOP ACTUATOR FOR DIESEL ENGINE

[75] Inventor: Anthony J. Gaeti, Chicago, Ill.

[73] Assignee: Synchro-Start, Skokie, Ill.

[21] Appl. No.: 238,579

[22] Filed: Aug. 31, 1988

[51] Int. Cl.[5] ..... F02M 39/00

[52] U.S. Cl. ..... 123/357; 123/198 DB; 123/365

[58] Field of Search ..... 123/357, 358, 359, 198 D, 123/198 DB, 365

[56] References Cited

U.S. PATENT DOCUMENTS

| | | | |
|---|---|---|---|
| T998,002 | 9/1980 | Miller | 123/358 |
| 3,202,161 | 8/1965 | Richards | 123/359 |
| 3,587,540 | 6/1971 | Hofmann | 123/357 |
| 4,148,289 | 4/1979 | Hewitt | 123/198 DB |
| 4,191,061 | 3/1980 | Miller | 74/108 |
| 4,212,279 | 7/1980 | Ohtani | 123/357 |
| 4,270,502 | 6/1981 | Seilly | 123/357 |
| 4,295,540 | 10/1981 | Hildebrecht | 123/198 D |
| 4,351,293 | 9/1982 | Hewitt | 123/198 DB |
| 4,450,804 | 5/1984 | Sauerschell | 123/357 |

FOREIGN PATENT DOCUMENTS 2923560 12/1979 Fed. Rep. of Germany ..... 123/357

*Primary Examiner*—Carl Stuart Miller

*Attorney, Agent, or Firm*—Kinzer, Plyer, Dorn, McEachran & Jambor

[57] ABSTRACT

A solenoid is affixed to a bracket having a base complementary in configuration to a portion of the housing of a diesel engine fuel pump governor that is spaced from the governor's run/stop member; the bracket is mounted on the governor housing by two bolts that also serve to join two halves of the governor housing. A lever mounted on the run/stop member of the governor is connected, by a connecting rod and swivel connection, to the solenoid plunger, so that plunger movement responsive to energization of the solenoid rotates the run/stop member to a RUN position; on de-energization of the solenoid its spring drives the run/stop member to a STOP position. A support rod affixed to the center of the bracket and mounted to the governor housing by a cover mounting bolt braces the bracket against engine vibration.

6 Claims, 2 Drawing Sheets

ELECTROMECHANICAL RUN/STOP ACTUATOR FOR DIESEL ENGINE

BACKGROUND OF THE INVENTION

The operator of a diesel engine, in a vehicle or other application, frequently has three operational engine controls. There is an electrical switch for actuating a starter motor and a mechanical linkage to a throttle to govern engine speed, corresponding to the basic controls for a gasoline engine; the diesel engine also has a run/stop control. This latter control actuates a run/stop member on the governor for the fuel pump of the engine and must be actuated (rotated) from a STOP position to a RUN position in order to condition the fuel pump of the diesel engine for operation.

Two different kinds of actuator linkage have been employed for the run/stop member of the fuel pump governor of a diesel engine. The simplest and most direct actuator is a cable connection or other mechanical linkage from the run/stop member to a plunger or lever accessible to the vehicle operator. However, many manufacturers and users of equipment powered by diesel engines consider a mechanical linkage of this kind undesirable. This has led to adoption of solenoid actuators, in which the plunger of a solenoid is connected to the run/stop member on the fuel pump governor so that energization of the solenoid drives the run/stop member to its RUN position permitting operation of the engine. When the solenoid is de-energized, its internal spring, or another spring mechanism, returns the plunger to an initial position and rotates the run/stop member of the governor to its STOP position, shutting off operation of the fuel pump. In some installations, the electrical switch for energization and de-energization of the solenoid is combined with the electrical switch for the starter motor so that the overall control is essentially a duplicate of that for a conventional gasoline engine with electrical ignition. In this way, the diesel engine control is more familiar to a greater variety of operators.

Solenoid actuators for the run/stop governor control in a diesel engine encounter several technical difficulties, particularly in the crowded conditions prevalent in many diesel engine installations. The fuel pump and its governor, in a vehicular diesel engine or other engine installation, are often quite inaccessible due to many other equipment items mounted in the engine compartment. Thus, mounting of a solenoid actuator for the run/stop control member of the governor, in the engine compartment, often presents a serious problem with respect to determination of a mounting position that will allow a connection between the solenoid plunger and the run/stop member. Furthermore, due to manufacturing variations, and particularly variations in engine mounting, individual adjustment of the length of the connecting linkage between the solenoid plunger and the run/stop member is almost always essential and quite critical. In this respect, it may be noted that if the solenoid does not provide for an adequate stroke upon energization, the maximum rated fuel flow for the engine cannot be realized and the available power is undesirably reduced.

SUMMARY OF THE INVENTION

The object of the present invention, therefore, is to provide a new and improved solenoid actuated electromechanical run/stop actuator for a diesel engine fuel pump governor that is simple and inexpensive in construction, suitable for operation over extended periods of time, and requires no individualized adjustment on installation.

Accordingly, the invention relates to an electromechanical run/stop actuator for a diesel engine fuel pump governor of the kind comprising a plurality of housing members conjointly affording a housing for the governor, a plurality of housing fasteners for securing the governor housing members to each other, and a run/stop member rotatable through a predetermined angle between alternate STOP and RUN positions. The actuator comprises a bracket having a base with a configuration complementary to a portion of the governor housing spaced from the run/stop member, main bracket fastener means, including at least one fastener for replacing at least one housing fastener, for mounting the bracket on the governor housing, a support rod having one end affixed to the bracket at a location displaced from the main bracket fastener means, support rod fastener means, including a fastener for replacing at least one housing fastener for affixing the other end of the support rod to the housing at a location displaced from the bracket, thereby bracing the bracket to withstand vibration of the engine, and a solenoid, affixed to the bracket, having a plunger aligned with the run/stop member and movable between alternate extended and retracted positions in response to changes in energization of the solenoid, the solenoid including a spring biasing the plunger toward one of its alternate positions. A lever is mounted on the run/stop member, a connecting rod of predetermined length has one end affixed to the lever, with a swivel connection between the other end of the connecting rod and the plunger. Energization of the solenoid drives the lever to rotate the run/stop member to one of its alternate positions and de-energization of the solenoid permits the spring to drive the lever to rotate the run/stop member to its other alternate position.

DESCRIPTION OF THE PREFERRED EMBODIMENT

Figure 1:
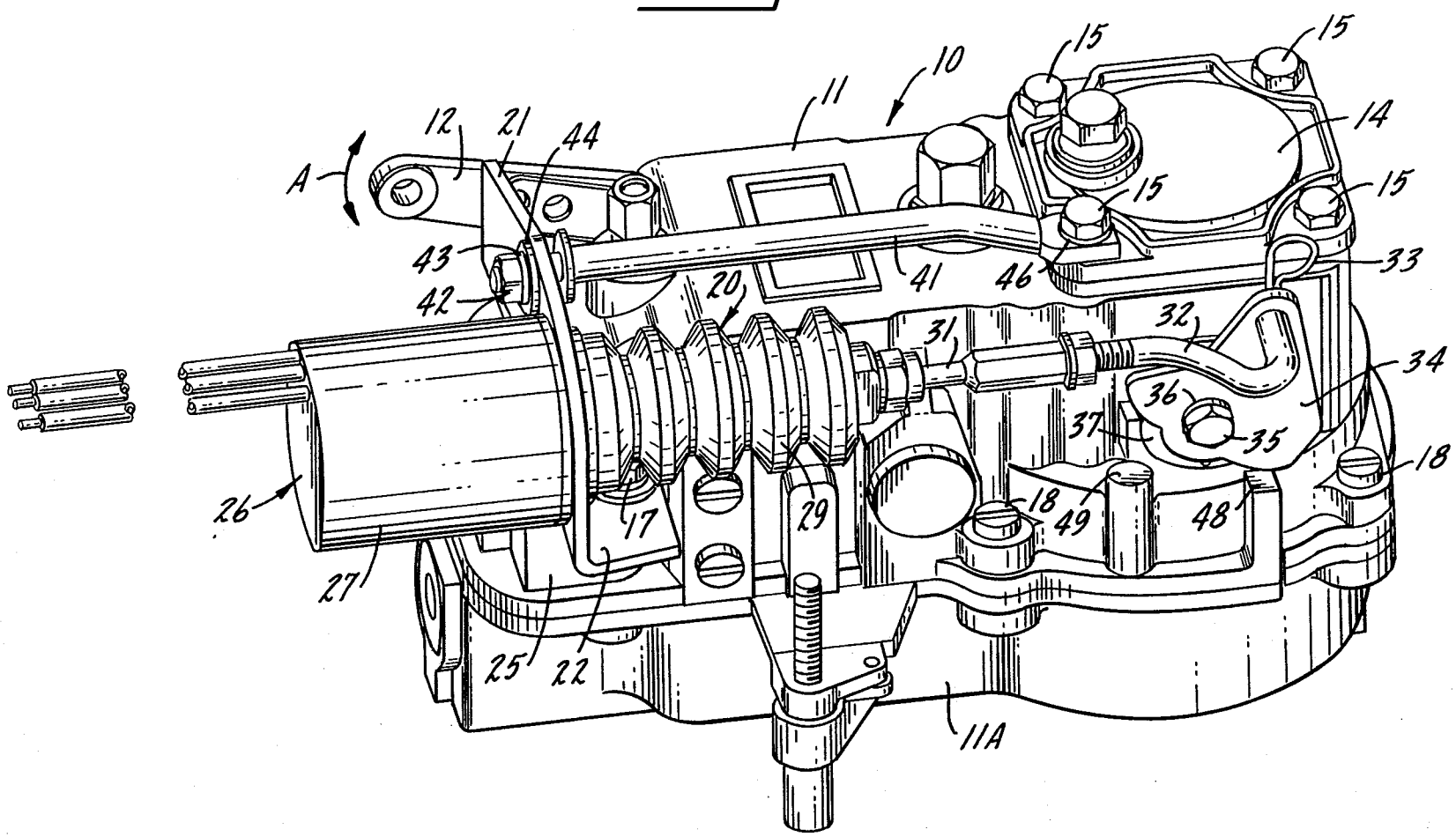
FIG. 1 is a perspective illustration of a diesel engine fuel pump governor equipped with an electromechanical run/stop actuator constructed in accordance with a preferred embodiment of the invention.
Figures 2, 3:
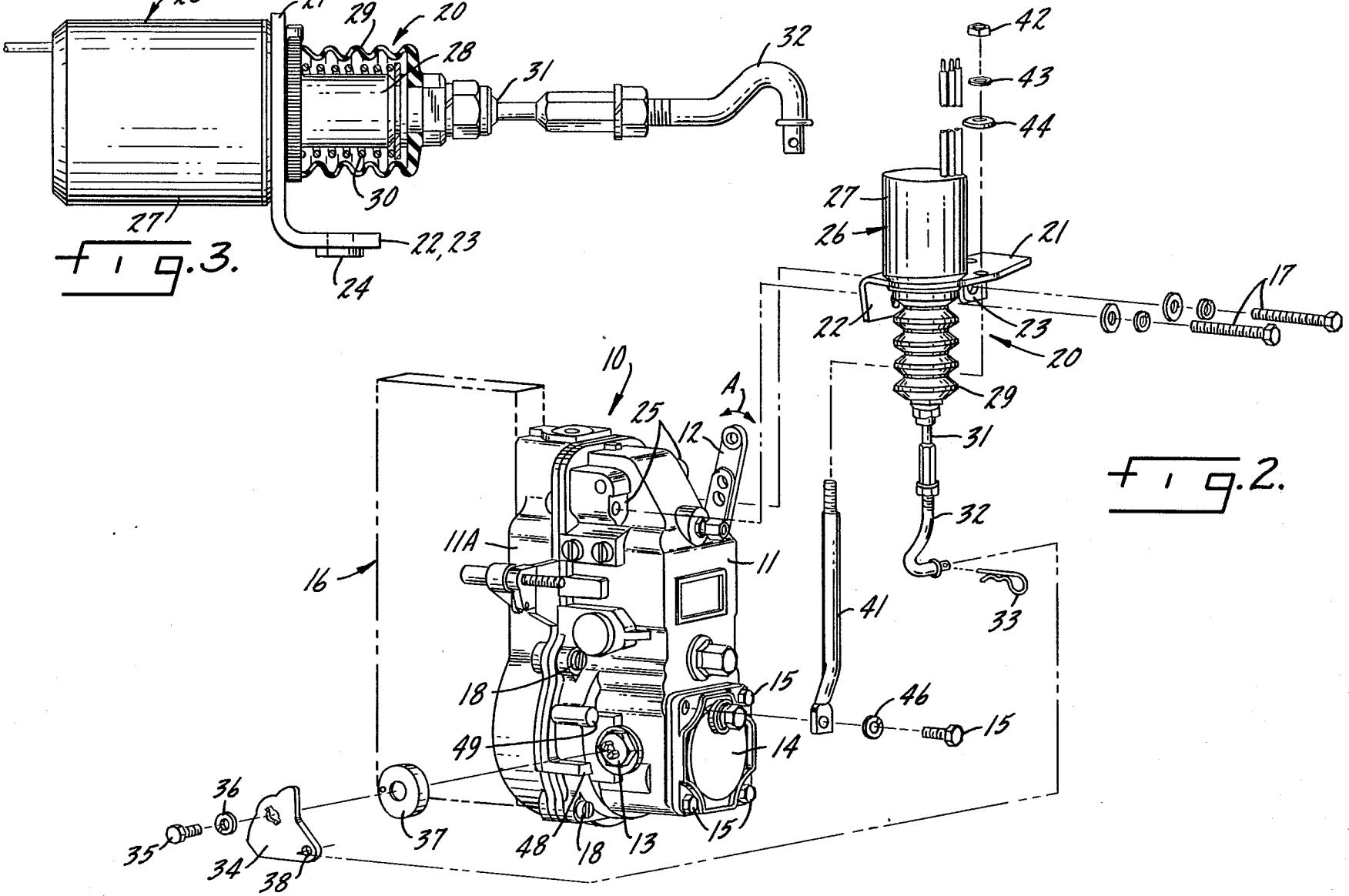
FIG. 2 is an exploded perspective view of the governor, fuel pump, and actuator of FIG. 1.
FIG. 3 is a side elevation view, partly in cross-section, of the electromechanical run/stop actuator of FIGS. 1 and 2 in actuated condition.

FIGS. 1 and 2 illustrate a governor 10 for a diesel engine fuel pump. Governor 10 includes a cast metal housing, formed in two mating halves 11 and 11A and having a throttle lever 12 mounted at one end. A pair of elongated bolts or similar fasteners 17 at the throttle end of the governor housing and four shorter similar bolts or fasteners 18 at the center and at the other end join the two housing halves 11 and 11A. In operation of the diesel engine with which governor 10 is employed, engine speed is controlled by rotating lever 12 as indicated by arrows A in FIGS. 1 and 2. At the end of housing 11 opposite throttle 12, governor 10 includes a run/stop member 13, as shown in FIG. 2. Run/stop member 13 is rotatable through an angle of about 60° between a RUN position and a STOP position; it controls a mechanism within governor 10 that allows operation of the fuel pump for the diesel engine when member 13 is in its RUN position but precludes any flow of fuel to the engine when member 13 is in its STOP position. The mechanism in governor 10 actuated by run/-stop member 13 is enclosed, in part, by an access cover 14 mounted on the same end of housing 11 by a plurality of short bolts or like fasteners 15. Governor 10 is mounted on a fuel pump 16 for the diesel engine that it serves; a part of fuel pump 16 is shown, only generally, in phantom lines in FIG. 2.

FIGS. 1 and 2 further illustrate an electromechanical run/stop actuator 20 for diesel engine fuel pump governor 10. Actuator 20, a preferred embodiment of the invention, includes a right-angle bracket 21 having a two-part base 22 and 23. The base 22,23 of bracket 21 has a configuration complementary to a portion 25 of the housing half 11 of governor 10. In the construction shown in FIGS. 1–3, each of the base portions 22 and 23 of bracket 21 has a washer 24 brazed to the bracket base to engage housing portion 25 and establish bracket 21 at the desired height relative to other elements of governor 10; see FIG. 3.

The electromechanical run/stop actuator 20, FIGS. 1–3, includes a solenoid 26 having a housing 27 that is brazed or otherwise firmly secured to bracket 21. Solenoid 26 further comprises a plunger 28 normally maintained in an extended position by a spring 30 disposed within a rubber or other elastomer boot 29, as shown in FIG. 3. An in-line-swivel 31 of conventional construction is affixed to the end of solenoid plunger 28 (FIGS. 1–3). The other end of swivel 31 is affixed to a connecting rod 32. A threaded connection may be employed between swivel 31 and connecting rod 32 to permit accurate pre-adjustment of the overall length of these two elements, at the factory, before actuator 20 is mounted on governor 10. Thus, no adjustment is entailed when actuator 20 is connected to governor 10.

Connecting rod 32, as illustrated, is of a hook-shaped configuration and engages in an aperture in a lever 34 that is connected to the rotary run/stop member 13 of diesel engine fuel pump governor 10. A pin 33 completes the working connection between lever 34 and connecting rod 32. A bolt or other fastener 35, preferably with a lock washer 36, secures lever 34 to run/stop member 13. A cover 37 may be provided for protection of the governor mechanism and its run/stop member.

Actuator 20 further comprises a support rod or brace 41. One end of brace 41 is affixed to bracket 21 by appropriate means such as a nut 42, a lock washer 43, and an additional washer 44 on one side of the bracket. The other end of brace 41 is secured to housing 11 adjacent cover 14 by removing one of the cover fasteners 15 and utilizing that fastener and a lock washer 46 to mount the end of brace 41 on the governor housing; see FIG. 2.

Two projections 48 and 49 on governor housing half 11 are available for use as stops for rotary movement of lever 34. In the STOP position for actuator 20 and lever 34, illustrated in FIG. 2, lever 34 engages projection 48 of housing 11 and can rotate no further in a clockwise direction, thus defining the STOP position for governor 10 and its run/stop member 13. On the other hand, if solenoid 26 is energized and lever 34 is rotated counterclockwise, projection 49 on housing 11 is positioned to engage the lever and stop its movement at a maximum RUN position. Actually, the RUN position (see FIG. 3) is defined by solenoid 26 bottoming out, just short of contact between lever 34 and housing projection 49 (FIG. 1); projection 49 is simply a safety stop for the RUN position of actuator 20.

The installation procedure for actuator 20 is best illustrated in FIG. 2. In a retrofit installation, the run/-stop lever normally provided on governor 10 for connection to a cable (not shown) is removed; the bias spring usually provided for run/stop member 13 is also removed and discarded. Lever 34 of actuator 20 is installed on member 13 for replacement of cover 37 and is held in place by bolt 35 and lock washer 36.

The two bolts 17 normally engaging housing portions 25, joining the housing halves 11 and 11A near throttle lever 12, are removed. Usually, it is necessary to replace the original bolts 17 with two bolts of slightly greater length. The replacement bolts 17 are utilized to mount base elements 22 and 23 of bracket 21 on portions 25 of housing 11. As before, the same bolts 17 are used to join housing halves 11 and 11A.

Connecting rod 32 is now engaged in the hole 38 in lever 34 (FIG. 2) and pin 33 is used to complete the linkage between the connecting rod and the lever. Support rod 41 is mounted on bracket 21 by means of nut 42, lock washer 43, and washers 44. One secondary (cover) bolt 15 is removed from housing 11 and the free end of support rod 41 is secured to the housing by that bolt 15 and lock washer 46. Again, a slightly longer bolt may be needed. There is no need or occasion to adjust the length of the elements 31 and 32 of actuator 20 that project beyond the end of solenoid plunger 28 to connect it to lever 34 (FIGS. 2 and 3) because the overall length of this portion of actuator 20 is accurately pre-set at the time of assembly in the factory where the actuator is made. The swivel connection 31 compensates for any angular discrepancies in the overall actuator and effectively allows for angular displacement of connector 32, relative to the axis of plunger 28, during operation of actuator 20.

To the engine operator, the operation of actuator 20 is the same as for any other solenoid arrangement for operation of run/stop member 13 of governor 10. When the engine operator is ready to start the diesel engine, he turns or otherwise actuates an electrical switch to energize solenoid 27, which pulls the plunger of the solenoid and its extensions 31 and 32 to the left from the extended position shown in FIG. 1 to the retracted position illustrated in FIG. 3. This rotates run/stop member 13 approximately 60° counterclockwise (FIG. 2) from its STOP position to its RUN position. This rotation of member 13 conditions governor 10 and fuel pump 16 so that the fuel pump can supply fuel to the diesel engine.

The operator next actuates the usual electrical switch to energize the starter motor that turns the diesel engine over and starts it in operation. That switch can be ganged with the switch for energization of solenoid 26 in the same manner as in the ignition switch of a conventional gasoline engine with electrical ignition. Thereafter, control of the rotational speed of the engine is exercised by throttle lever 12 through a conventional mechanical linkage. When the engine operator desires to stop the engine, the energizing switch for solenoid 26 is opened and the return spring 29 of the solenoid (FIG. 3) drives plunger 28 and its extensions 31 and 32 outwardly of the solenoid housing 27, back to the STOP position shown in FIG. 1. The resulting clockwise rotation of lever 34 effectively turns member 13 (FIG. 2) to its STOP position and shuts off the flow of fuel to the engine so that the engine stops.

In the drawings actuator 20 is shown mounted on a Robert Bosch GmbH Type RSV governor 10, a governor that is used on diesel engines of several different constructions. Of course, the construction requires modification to fit the housings of other types of governor. Actuator 20 actuates governor 10 to RUN condition by energization of solenoid 26 with spring 29 effecting a change to the STOP condition when the solenoid is de-energized; it will be recognized that these relations can be reversed or otherwise modified as desired to meet the needs and requirements of different engine installations.

I claim:

1. An electromechanical run/stop actuator for a diesel engine fuel pump governor of the kind comprising a plurality of housing members conjointly affording a housing for the governor, a plurality of housing fasteners for securing the governor housing members to each other, and a run/stop member rotatable through a predetermined angle between alternate STOP and RUN positions, the actuator comprising:

a bracket having a base with a configuration complementary to a portion of the governor housing spaced from the run/stop member;

main bracket fastener means, including at least one fastener for replacing at least one housing fastener, for mounting the bracket on the governor housing;

a support rod having one end affixed to the bracket at a location displaced from the main bracket fastener means;

support rod fastener means, including a fastener for replacing at least one housing fastener for affixing the other end of the support rod to the housing at a location displaced from the bracket, thereby bracing the bracket to withstand vibration of the engine;

a solenoid, affixed to the bracket, having a plunger aligned with the run/stop member and movable between alternate extended and retracted positions in response to changes in energization of the solenoid, the solenoid including a spring biasing the plunger toward one of its alternate positions;

a lever mounted on the run/stop member;

a connecting rod of predetermined length having one end affixed to the lever;

and a swivel connection between the other end of the connecting rod and the plunger, whereby energization of the solenoid drives the lever to rotate the run/stop member to one of its alternate positions and de-energization of the solenoid permits the spring to drive the lever to rotate the run/stop member to its other alternate position.

2. An electromechanical run/stop actuator for a diesel engine fuel pump governor, according to claim 1, in which:

one of the governor housing members is a cover affixed to the housing by a plurality of secondary housing fasteners;

the support rod has its one end affixed to the center of the bracket; and the support fastener means for the other end of the support rod is a replacement fastener for one of the secondary housing fasteners.

3. An electromechanical run/stop actuator for a diesel engine fuel pump governor, according to claim 1, in which the fasteners are all bolts, in which movement of the plunger to its retracted position is effected by energization of the solenoid, which drives the lever to rotate the run/stop member to its RUN position, and in which movement of the plunger to its extended position is effected by the spring, which drives the lever to rotate the run/stop member to its STOP position.

4. An electromechanical run/stop actuator for a diesel engine fuel pump governor, according to claim 1, in which the lever engages the housing to define the STOP position for the run/stop member.

5. An electromechanical run/stop actuator for a diesel engine fuel pump governor, according to claim 2, in which the fasteners are all bolts, in which movement of the plunger to its retracted position is effected by energization of the solenoid, which drives the lever to rotate the run/stop member to its RUN position, and in which movement of the plunger to its extended position is effected by the spring, which drives the lever to rotate the run/stop member to its STOP position.

6. A An electromechanical run/stop actuator for a diesel engine fuel pump governor, according to claim 2, in which the lever engages the housing to define the STOP position for the run/stop member.

* * * * *